US010047922B2

(12) United States Patent
Chien

(10) Patent No.: US 10,047,922 B2
(45) **Date of Patent: *Aug. 14, 2018**

(54) LED LIGHT INCLUDES AT LEAST ONE OPTICS LENS HAVING REFLECTIVE AND/OR REFRACTIVE PROPERTIES TO CREATE A WIDER VIEWING ANGLE IMAGE

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/451,822

(22) Filed: Aug. 5, 2014

(65) Prior Publication Data

US 2015/0070937 A1 Mar. 12, 2015

Related U.S. Application Data

(63) Continuation-in-part of application No. 14/023,889, filed on Sep. 11, 2013.

(51) Int. Cl.

| | |
|---|---|
| ***F21K 99/00*** | (2016.01) |
| ***F21S 10/02*** | (2006.01) |
| ***F21V 5/00*** | (2018.01) |

(52) U.S. Cl.
CPC ..... *F21S 10/02* (2013.01); *F21V 5/00* (2013.01)

(58) Field of Classification Search
CPC ..... F21S 10/02; F21V 5/00
See application file for complete search history.

(56) References Cited

U.S. PATENT DOCUMENTS

| | | | | |
|---|---|---|---|---|
| 7,455,444 | B2 | 11/2008 | Chien | |
| 7,632,004 | B2 | 12/2009 | Chien | |
| 7,832,917 | B2 | 11/2010 | Chien | |
| 7,832,918 | B2 | 11/2010 | Chien | |
| 7,871,192 | B2 | 1/2011 | Chien | |
| 8,083,377 | B2 | 12/2011 | Chien | |
| 8,277,087 | B2 | 10/2012 | Chien | |
| 8,303,150 | B2 | 11/2012 | Chien | |
| 8,434,927 | B2 | 5/2013 | Chien | |
| 2006/0152946 | A1* | 7/2006 | Chien | A61L 9/03 362/641 |

* cited by examiner

*Primary Examiner* — Elmito Breval
(74) *Attorney, Agent, or Firm* — Bacon & Thomas, PLLC

(57) ABSTRACT

An LED and/or laser light device having a plug-in AC power source, an interchangeable power source, or a USB power source incorporates more than one optical-lens which having more than one reflective or refractive area or sections or surfaces, and at different positions, distances, and/or orientations relative to the LEDs and/or laser light source of the LED or laser light to cause light beams to reflect or-and refract before passing through the top optical-lens and create or project an image, message, time, geometric art, nature scene, galaxy, milky way, sky, cloud, starts, moon, water-wave, aurora light, animal, characters, cartoon, sign, logo, commercial to at least one surface surrounding or-and away-from the light device. The optical-lens may have a predetermined texture and/or shaped openings, windows, cutouts, or variable thicknesses and further may incorporate parts and accessories such as a motor to provide moving image effects with a wide viewing angle and variable colors or patterns.

10 Claims, 4 Drawing Sheets

Fig. 1
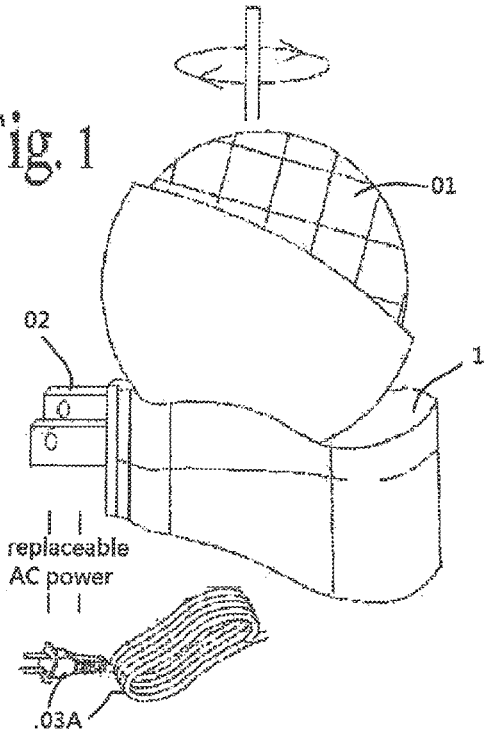
Fig. 1-1
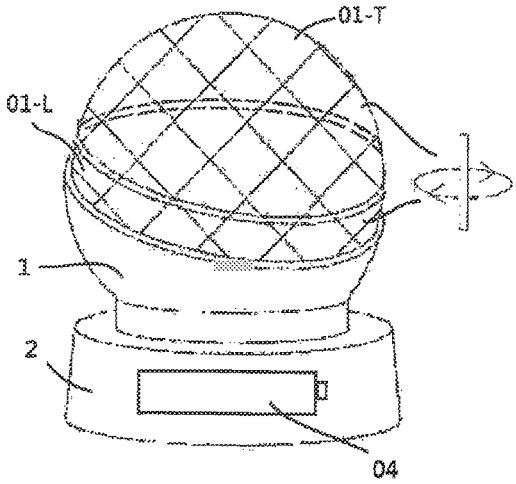
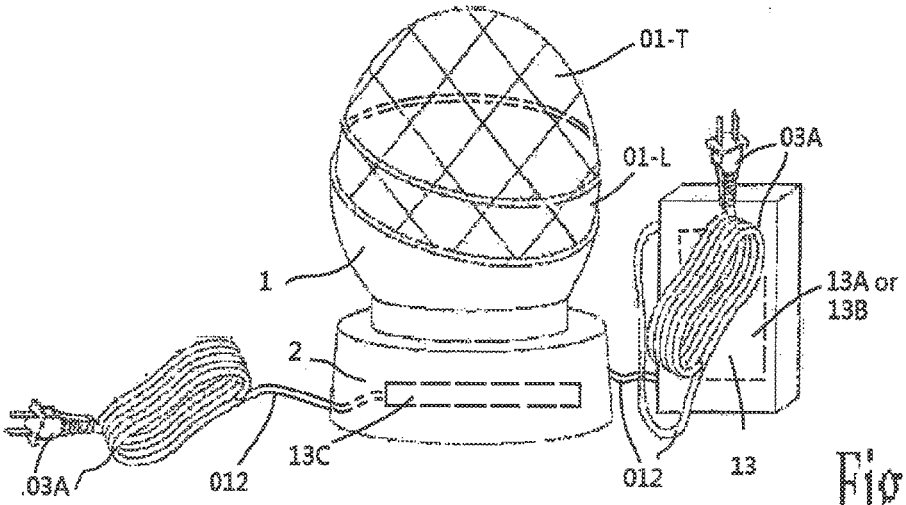
Fig. 1-2

Fig. 2
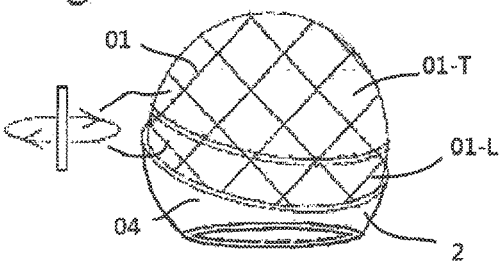
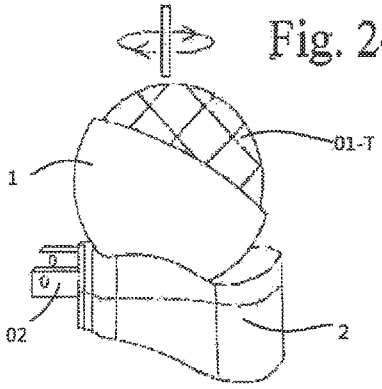
Fig. 2-1
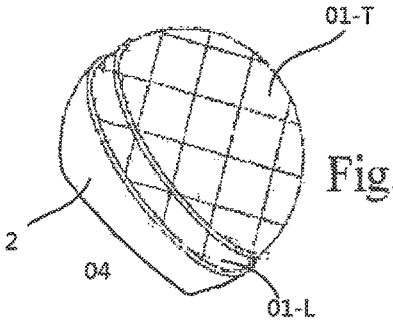
Fig. 2-2
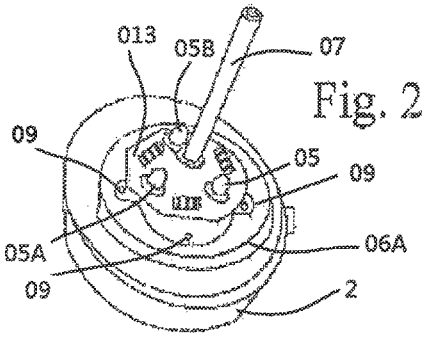
Fig. 2-3
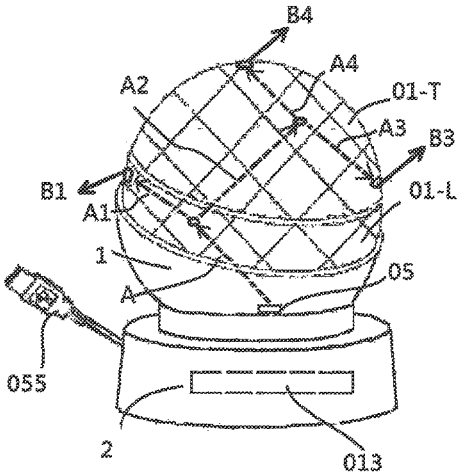
Fig. 2-5
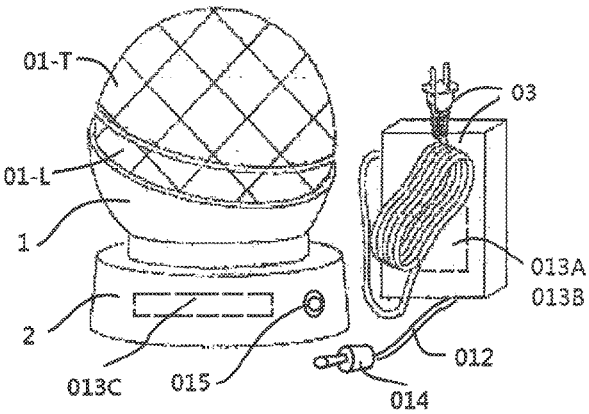
Fig. 2-4

Fig 4
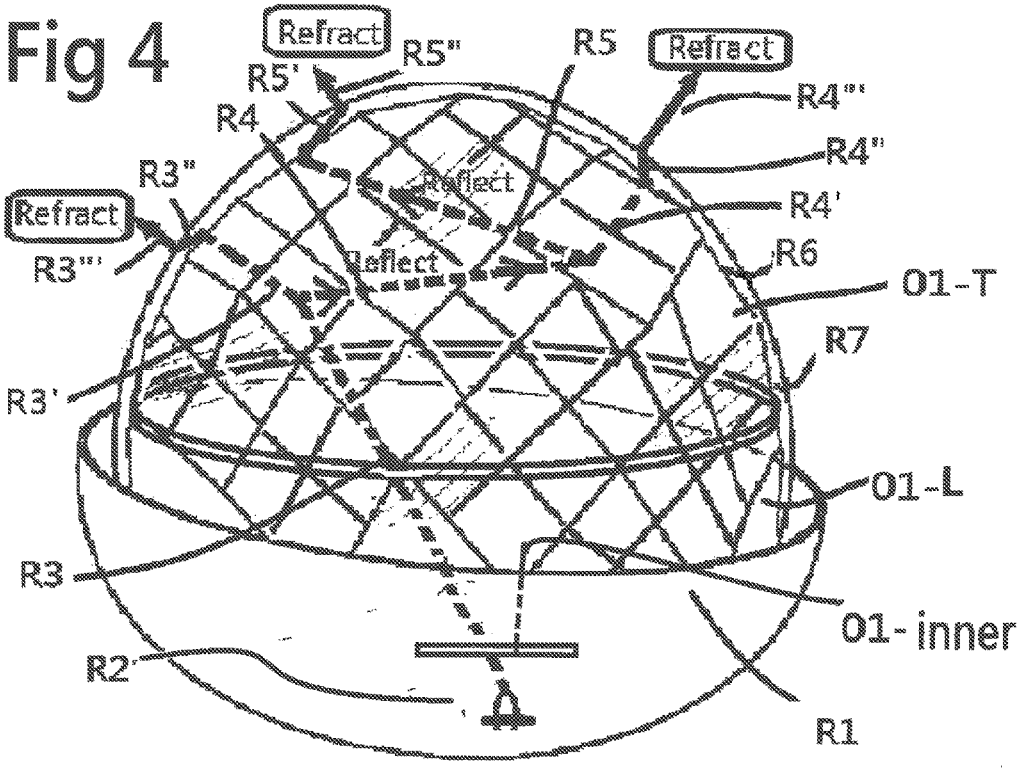
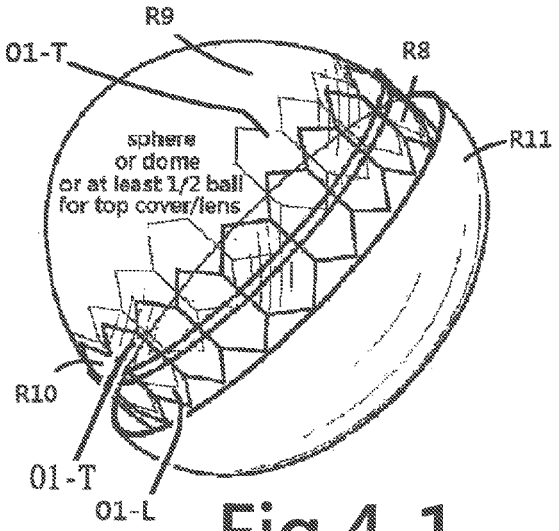
Fig 4-1
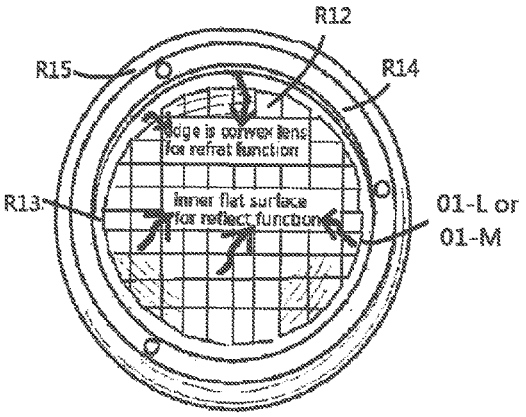
Fig 4-2

LED LIGHT INCLUDES AT LEAST ONE OPTICS LENS HAVING REFLECTIVE AND/OR REFRACTIVE PROPERTIES TO CREATE A WIDER VIEWING ANGLE IMAGE

This application is a continuation-in-part of U.S. patent application Ser. No. 14/023,889, filed Sep. 11, 2013.

BACKGROUND OF THE INVENTION

A lot of bulky desk top devices having some optics and noisy motor to get images to the walls or ceiling are available in the marketplace. None of these devices have a compact size, light weight, or low cost.

According to one embodiment of the current invention, an image projector is provided for displaying a desired image, message, time, geometric art, nature scene, galaxy, milky way, sky, cloud, stars, moon, water-wave, aurora light, animal, characters, cartoon, sign, logo, or commercial on a desired surface and which has a compact size with light weight to allow people to achieve plug-in installation to any outlet device, such as a wall outlet, extension cord, power strip, outlet device.

A plug-in outlet or USB port allows easy connection with a power source without the disadvantages of an AC wired connection, an adaptor with a wired connection, or a transformer with a wire device, in which the wires are very difficult to handle and may cause people to fall down or be touched.

In addition, the plug-in outlet or USB port serves as an unlimited power source, unlike market-available models which are battery operated for desk top applications and which as a result require frequent change of battery to supply enough electricity for a plurality of LEDs, which may need hundreds of milliamps of current to per hour.

Consequently, the current invention, which is arranged to be plugged into outlets or USB ports, represents a big improvement over market-available desk top LED or laser light devices with wired connections or battery units. It is still possible to include a motor, rotating, or magnet and magnetic-coil to provide moving effects, but in that case it may be necessary to use a wired power source, which will cause the consumer to fall down and is too risky for desk top installation, so it is preferred use direct plug-in to an outlet or a USB with no wires.

According to a third preferred embodiment, the current invention may use an alternative design to create moving effects without the need to use a motor, or rotating magnetic and magnetic-coil, in order to reduce costs, i.e., the LED does not use any motor to create the changeable image, message, time, geometric art, nature scene, galaxy, milky way, sky, cloud, stars, moon, water waves, animal, characters, cartoon, sign, logo, commercial.

According to a fourth preferred embodiment, a big improvement provided by the current invention is to have all moving or motion effects made by a plurality of LEDs' sequential flashing, fade-in and fade-out, color changing, sequential, random, or other LED light performances or effects by turning individual LEDs on and off with a time difference, duration, or duty cycle and cause the resulting image to appear as if it were moving.

According to a fifth preferred embodiment, a more advanced improvement is to generate a shaped image, message, time, geometric art, nature scene, galaxy, milky way, sky, cloud, stars, moon, water-wave, aurora light, animal, characters, cartoon, sign, logo, or commercial from at least one or more optics having a preferred texture, opening, cutouts, holes, or shape and a steady LED light beam with rotating or non-rotating.

The preferred embodiments of the current invention may utilize features disclosed in the inventor's copending U.S. patent application Ser. No. 14/023,889, filed Sep. 11, 2013; Ser. No. 14/323,318; filed on Jun. 26, 2014 and Ser. No. 12/938,564, filed Nov. 2, 2014; and U.S. Pat. No. 7,455,444 (more than one LED light source); U.S. Pat. No. 7,632,004 (more than one optic); and U.S. Pat. No. 8,277,087 (more than one reflective to create multiple visible image).

The current has subject matter in common with the inventor's following copending applications: U.S. patent application Ser. No. 14/024,229 (LED light has kaleidoscope); Ser. No. 13/021,124 (LED light having changeable image and pattern by kaleidoscope to project to surfaces); Ser. No. 12/710,918 (LED light having more than one reflector), now U.S. Pat. No. 8,277,087, the arrangement of which may be utilized in the current by providing a kaleidoscope having more than one reflective that uses a mirror or mirror-like assembled into the kaleidoscope; Ser. No. 11/806,284 (LED light having more than one optic), now U.S. Pat. No. 7,632,004, which discloses an arrangement that may be utilized by the current invention by applying the more than one optics in front of or in back of back of a kaleidoscope to create, adjust, magnify, reduce, or enlarge an image, LED light beams, or an LED lights' shape, the optics including any combination of an optics lens, optics mirror, laser hologram, laser grating film, or optics assembly.

The inventor's U.S. Pat. No. 7,455,444 discloses an LED light having more than one LED light source, the current invention also capable of utilizing more than one LED in a matrix arrangement with circuit, IC, sensor, switch, brightness control, color mixing, color selection, color freeze, motor, gear, and turn-on/turn-off to cause a certain number of LEDs to be turned-on with desired colors, brightness, light brightness output, light functions, matrix combinations, motor, rotating, and/or gear set to cause light to pass through the kaleidoscope and optics to achieve desired light patterns.

Other U.S. patent applications of the inventor include U.S. patent application Ser. Nos. 12/948,953; 12/938,564; 12/886,832; 12/876,507; 12/771,003; 12/624,621; 12/914,584; 12/318,471; 12/318,470; and Ser. Nos. 12/834,435; 12/292,153 (now U.S. Pat. No. 7,871,192); Ser. No. 12/232,505 (now U.S. Pat. No. 7,832,917); and Ser. No. 12/318,473 (now U.S. Pat. No. 7,832,918), Additional patent applications of the inventor that disclose projection lights include U.S. patent application Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. Nos. 12/886,832; 12/938,564; 12/948,953; and Ser. No. 13/021,107.

Furthermore the inventor also has copending U.S. patent applications for light devices having interchangeable power sources for AC wall outlets and DC energy storage, including all kinds of combinations selected from prong, extension cords, adaptors, transformers, solar or wind power, batteries, chemical power, and biological power, all of which can be interchanged to provide AC or battery power in any desk top or plug in type projection light device having a built-in kaleidoscope. The inventor's interchangeable power source applications U.S. patent application Ser. Nos. 12/318,473 and 12/940,255 (now U.S. Pat. No. 8,231,246).

The current invention thus may utilizes principles and structures from a variety of the inventor's patents or copending patent applications, such as: (1) a projection light device; (2) more than 1 optics; (3) more than 1 LED; (4) more than 1 reflective; (5) interchangeable power sources; (6) laser; (7) adjustable focus and position changing; and (8) use of a motor and gear set for image adjustment and moving.

This application also has subject matter in common with U.S. patent application Ser. Nos. 12/710,561; 12/711,456; 12/771,003; 12/624,621; 12/622,100; 12/318,471; 12/318,470; 12/318,473; 12/292,153; 12/232,505; 12/232,035; 12/149,963; 12/149,964; 12/073,095; 12/073,889; 12/007,076; 12/003,691; 12/003,809; 11/806,711; 11/806,285; 11/806,284; 11/566,322; 11/527,628; 11/527,629; 11/498,874; 12/545,992; 12/806,711; 12/806,285; 12/806,284; 12/566,322; 12/527,628; 12/527,629; 12/527,631; 12/502,661; 11/498,881; 11/255,981; 11/184,771; 11/152,063; 11/094,215; 11/092,742; 11/092,741; 11/094,156, 11/094,155, 10/954,189; 10/902,123, 10/883,719; 10/883,747; 10/341,519; 12/545,992; and 12/292,580.

In particular, the following applications show light devices that have at least some features in common with included or optional features of the LED light device of the present invention: Ser. No. 12/710,561 ("LED power failure Light"); Ser. No. 12/711,456 ("LED light device has special effects"); Ser. No. 12/771,003 ("LED light device has more than 1 reflective for plurality of image"); Ser. No. 12/624,621 ("projection device or assembly for variety of LED light"); Ser. No. 12/622,000 ("Interchangeable Universal Kits for all LED light"); Ser. No. 12/318,471 ("LED night light with pinhole imaging"); Ser. No. 12/318,470 ("LED night light with Projection features"); Ser. No. 12/318,473 ("LED night light with laser or hologram element"); Ser. No. 12/292,153 ("LED night light with Projection or imaging features"); Ser. No. 12/232,505 ("LED night light with Projection features"); Ser. No. 12/149,963 ("Removable LED light device"); Ser. No. 12/149,964 ("Surface Mounted Device with LED light"); Ser. No. 12/073,095 ("LED Track light device"); Ser. No. 12/073,889 ("LED light with changeable position with Preferable power source"); Ser. No. 12/007,076 ("LED light with changeable geometric system"); Ser. No. 12/003,691 ("LED light with changeable geometric dimension features"); Ser. No. 12/003,809 ("LED light with changeable features"); Ser. No. 11/806,711 ("Multiple LED light with adjustable angle features"); Ser. No. 11/806,285 ("LED Night light with outlet device"); Ser. No. 11/806,284 ("LED Night light with more than 1 optics"); Ser. No. 11/527,628 ("Multiple function Night light with air freshener"); Ser. No. 11/527,629 ("LED Night light with interchangeable display unit"); Ser. No. 11/498,874 ("Area illumination Night light"); Ser. No. 11/527,631 ("LED Time piece night light"); Ser. No. 12/545,992 ("LED time piece Night light"); Ser. No. 12/292,580 ("LED Time Piece Night light"); Ser. No. 11/498,881 ("Poly Night light"); Ser. No. 11/255,981 ("Multiple light source Night Light"); Ser. No. 11/184,771 ("Light Device with EL elements"); Ser. No. 11/152,063 ("Outlet adaptor with EL"); Ser. No. 11/094,215 ("LED night light with liquid medium"); Ser. No. 11/094,215 ("LED Night light with Liquid optics medium"); Ser. No. 11/092,741 ("Night light with fiber optics"); Ser. No. 10/883,747 ("Fiber Optic light kits for footwear"); Ser. No. 11/498,874 ("Area Illumination for LED night light"); Ser. No. 11/527,629 ("Time Piece with LED night light"); Ser. No. 11/527,628 ("Multiple Function Night light with Air Freshener"); Ser. No. 11/806,284 ("LED Night light with more than one optics mediums"); Ser. No. 11/806,285 ("LED Night Light with multiple function"); and Ser. No. 11/806,711 ("Multiple LEDs Light with adjustable angle function").

The applications of the inventor in general all apply physics or optics theory to a night light supplied with power from an outlet, battery, solar, or other power source. The present invention uses the physics or optics theory to create a plurality of LED light images on a surface. More specifically, the current invention uses more than one reflective to transform a single LED spot light into a plurality of images on a surface to be seen by viewer. The principles of the invention may be applied to night lights of various types, including night lights disclosed in the above-listed patents and patent applications of the inventor, which may be powered by a variety of power sources, such as an outlet, batteries, solar, wind, or chemical power sources.

Because of the persistence of vision effect, caused by the human eye response time of more than 1/24 (41,67) to 1/16 (0.0625) seconds, when an object moves faster than the human eye response time, the last image will stay in the human eye and brain for an extended period of time. This theory can utilized to save power by causing an LED or LEDs to flash with a very short on-time of around 10 msec or less. This principle is similar to that of a motion picture in which, if an object in front of human eye is displayed in 16-24 pictures per second, people will think all pictures are continuous. Hence, the current invention uses a related circuit, control, IC, and/or micro controller to cause an LED light device to blink at a rate that is much faster than 16-24 times (cycles) per second, with the LED or LEDs being turned on for 10% of each cycle and off for 90% of the cycle to save up to 90% of power consumption or increase battery life by nine times more than the full steady-ON condition. This is a significant power saving for all battery power source applications. It will be appreciated that new LEDs may be coming soon to enable the LEDs to have an even quicker response time of less than 10 msec, and possibly less than 5 msec or 2 msec, to provide even greater power saving. such adjustment of the duration of each cycle's turn-on and turn-off duration time will cause even more power saving to meet the green world concept. This is one of the very important concepts of the current invention.

Further cost saving can be achieved in the case of a battery powered unit by using a circuit with proper electric components, parts, and accessories to raise the voltage output of the batteries to trigger the LED or LEDs even though the number of batteries is less than that normally required to generate the required voltage. This can counter the tendency of people to use a large quantity of batteries and save substantial cost, which is another important advantage of the current invention.

A preferred embodiment of the current invention includes an LED night light with more than one reflective within the geometrically shaped optics to enable a plurality of LED light beams to pass through, reflect.

The LED night light includes at least one LED arranged inside a partially transparent geometric optics having more than one reflective, and at least one second reflective within the geometric optics which can reflect an LED light beams from its surface to the first or other reflective surfaces back and forth so that some LED light beams are reflected and travel within the optics and other LED light beams pass through a partially transparent optics to the outside.

In this embodiment, a plurality of the LED beams can project outside through a surface(s). Furthermore, at least one of the reflective may be partially transparent so that a plurality of light beams pass through from the surfaces thereof, while another plurality of LED light beams is reflected retro-reflected within another reflector and passes through some other surface(s).

The LED or LEDs of this embodiment are preferably connected with circuit, power, contact, conductive, switch, sensor, motor, spin, rotating, gear set, speed control, printed circuit, integrated circuit (I.C.) and/or related parts and accessories to cause the LED or LEDs to turn on and off according to a predetermined time period, functions, colors, and/or effects to provide a desired lighting performance.

In the above-described preferred embodiment, the reflective may be a mirror, chrome finished piece, polished piece, double-sided mirror, or any surface having reflective properties that permits light beams to pass through both optical elements of the current invention.

The partially transparent or see-though properties can be provided by a transparent piece, colored transparent piece, or any other piece that allows light beams to pass therethrough. A power source of this embodiment can be in the form of an outlet, batteries, solar power, chemical power, or wind power.

The LED or LEDs can be selected from any combination of single color, multiple color, multiple piece, standard, and special LED assemblies. The LEDs can be any number from 1 to N (N can be any number) arranged in a desired matrix or spacing.

Finally, the distance, position, and/or orientation of the reflective may be changed based on the selected geometric shape of the optics. The LED arrangement for different LED numbers, positions, colors, IC chip, control, circuit, functions, and brightness to create a desired plurality of light patterns, shows, color changing, image changing, or moving effects to be seen by people on surrounding surfaces including walls, a ceiling, a floor, or any other desired surface(s).

The geometric optics can have any shape with multiple constructions and combination of elements selected from a light transmitting lens, reflective lens, convex lens, concave lens, laser lens, and hologram lens on an inner or outside surface or on all sides to provide desired light effects.

According to another preferred embodiment of the invention, an LED light device having power saving features includes at least one LED or LEDs for a light source, at least one housing having space to install circuit, conductive, electric components parts and accessories, switch, sensor, an integrated circuit (IC), and/or a micro controller to connect with a conventional market-available power source to cause the LED or LEDs to turn on and turn to provide predetermined functions or effects, with a predetermined duty cycle, color, and/or brightness.

The power-saving features are obtained by using the control to cause the LED or LEDs turn-on for only a certain percentage of each cycle. In particular, the turn on time is selected to meet the persistence of vision of the human eye, so as to take advantage of the human eye's response time of 1/24 to 1/16 second so that the blinking LED or LEDs looks as if it were continuously on.

According to yet another embodiment of the invention, an LED light device having cost saving features includes at least one LED or LEDs as a light source, at least one housing having space to install circuit, conductive, electric components parts and accessories, switch, sensor, an integrated circuit (IC), and/or a micro controller to connect with a conventional market-available power source, preferably batteries, to cause the LED or LEDs to turn on and turn off according to a predetermined function or effects, duty cycle, color, and/or brightness.

In this embodiment, cost saving is obtained by providing batteries having a total voltage that is less than the LED trigger voltage and by providing electric components and related parts and accessories to increase the voltage output of the batteries to greater than the LED trigger voltage.

As noted above, the current invention uses geometrically shaped optics-means having built-in more than one reflective or refraction to create a plurality of LED light beams that pass through or are reflected or retro-reflected by the more than one. The relative distance, position, and/or orientation of the more than one reflective (and optional additional) reflective will result in different light beam performance. This is a very low cost and simple way to make a splendid and eye catching light projection unit for people, and which may incorporate any desired power source such as a battery, USB power, outlet power, generator power, chemical power, solar power, wind power or another equivalent power source from the marketplace.

BRIEF DESCRIPTION OF THE DRAWINGS

FIGS. 1, 2, and 2-1 shows a first preferred embodiment of the current invention having prong with plenty of reflective section or areas or parts inside a geometric optics-piece and plenty of convex-lens to cause a plurality of light beams to be emitted out and project images to be seen by a viewer.

FIGS. 1-1, 1-2, and 2-4 show a first preferred embodiment of the current invention having an AC power-connector with plenty of reflective sections or areas or parts inside the geometric optics-piece and plenty of convex-lens to cause a plurality of light beams to be emitted out and project the images to be seen by a viewer.

FIGS. 2-2, and 2-5 show a variation of the first preferred embodiment of the current invention having a DC power source, or USB power source, or an interchangeable power source with plenty of reflective sections or areas or parts inside the geometric optics-piece and plenty of convex-lens to cause a plurality of light beams to be emitted out to project the images to be seen by a viewer. FIG. 2-5 shows one of the splendid light images created by the current invention in a yellow color image.

FIG. 2-3 shows a further variation of the first preferred embodiment of the current invention, which is similar to the construction shown in FIG. 3.

FIGS. 3 and 3-1 show a preferred construction for an LED light having more than one reflection or refraction piece(s) and a motor and circuitry and axis to install optic-piece(s).

FIGS. 4, 4-1, and 4-2 show an arrangement in which light beams are emitted to a first reflective or-and refraction piece and then hit second, third, and fourth reflective or-and refraction piece within a ball housing or cover, the reflective or-and refraction piece each having a convex exterior shape so that it acts as a convex-lens to allow a light beam to be emitted out and allow a projected image to be seen. FIG. 4 shows that different reflective or-and refraction piece can be situated at different distances, positions, and orientations relative to each other.

From (FIG. 4-1) The preferred LED projection light application is for outdoor light has the top optic-lens (01-T) cover is a diamond-cut treated optic-lens has LED light source (R2) emit light-beam (R3) to inner flat reflective-area to split into (R3') and reflected light beam (R3') to hit the inner other points or area or segments or parts, and the said reflected light-beam pass through the wall material and deviate basing on the refractive physical theory as light beam (R3") to become refracted light-beam (R3'") came out from the outside surface. The light beam from LED (R3) →reflected→(R3')→refracted→(R3")→refracted→(R3'") this is one of the LED light traveling-path for preferred embodiment which has lower optic-lens (01-L) and top optics-lens (01-L). The LED light-beam (R3) reflected into not only have (R3') but also have the $2^{nd}$ reflected light-beam (R4)→Reflected→(R5)→refracted→(R5')→refracted→R5". Also, at the same time has the light-beam (R4) also not only reflected into (R5) but also have light-beam (R4') →refracted→(R4')→refracted→(R4")→refracted→(R4'"). The LED single light-beam can has plurality of light-beam been reflected or-and refracted within the lower or-and top optics-lens at same time and incorporate with motor (06) or-and gear-set (06') to make the preferred top or lower optics-lens to rotating will make more splendid lighted pattern or image for moving effects.

So the diamond-cut optic-lens for outdoor light front cover to incorporated with inner $1^{st}$ optics-lens such as rotating prism-lens can created splendid light performance. Furthermore, while change the LED color from 1 color to 2 color or more colors and IC control so can make the more assortments light performance outdoor lighting.

From (FIG. 4-2) show how to make the diamond-cut construction or other treatment for optics-lens (01-T) or optic-cover more than ½ ball. The top optic-lens (01-T) cover has one ½ half ball (R9) for top and add or assembled with lower partial of ball preferred optics-treatment optics-lens (01-L) so can make the top cover or top optics-lens (01) has more than ½ ball size. The reason to make more than ½ ball because we need to make much bigger size and more eye-exciting lighted image or-and pattern. The distance from the top cover or top optics-lens (01-T) to the lower (01-L) or inner $1^{st}$ optic-lens has related the best distance which is more than ½ ball because more distance can created more spread-out and more clear image or-and lighted patterns.

Figure 3:
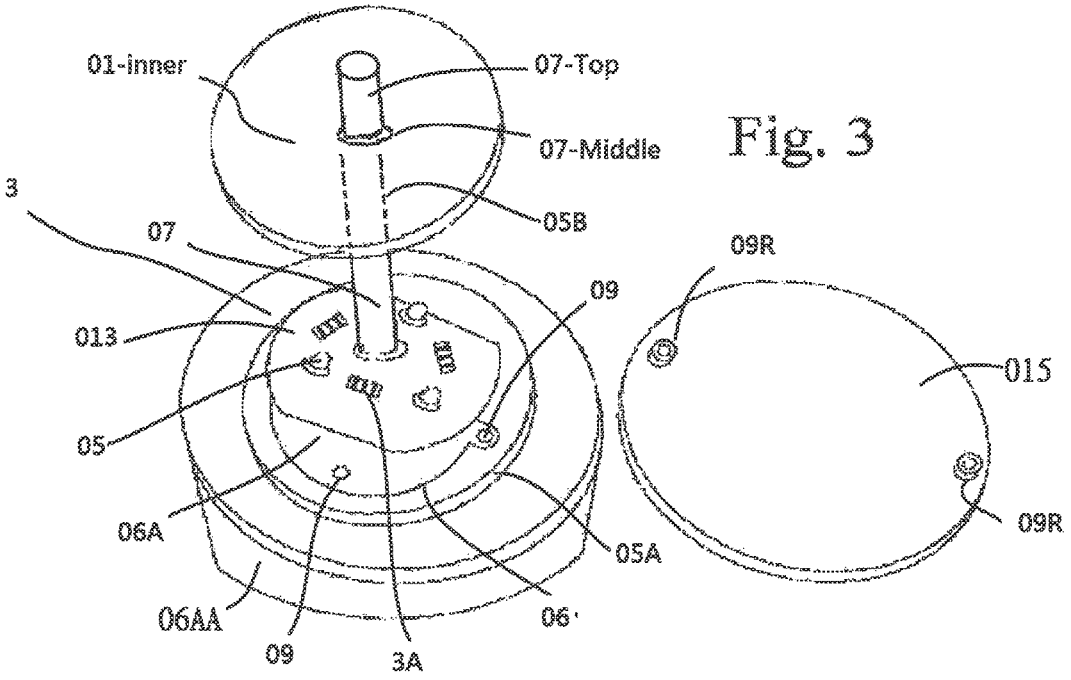

From FIG. 4-3) show the top (01-T) or lower (01-L) or inner (01-M) construction of the optic-lens which is diamond-cut optic-lens. The inner surface have a lot of flat surface (R12) which has high polished treated so can easily reflect all input light-beam and reflect to other direction depend on the input-angle of light-beam from LED(s). The one of diamond-cut optic-lens is the preferred for top (01-T) or-and lower (01-L) sphere $2^{nd}$ optic-lens outside is ball type so the outside is round and inner is flat surface so it become the convex lens (R13) so the $2^{nd}$ optic-lens for diamond-cut which also has plurality of the tiny convex-lens which offer the refractive optic-properties. This embodiment clear explain the diamond-cut $2^{nd}$ Top (01-T) optics-lens has both refractive or-and reflective optics properties in one top cover or top-lens to make the lower (01-L) or inner $1^{st}$ optic-lens came out light-beam to make more refraction and-or reflection to get splendid light effects.

DETAILED DESCRIPTION OF THE PREFERRED EMBODIMENTS

Figures 1, 3:
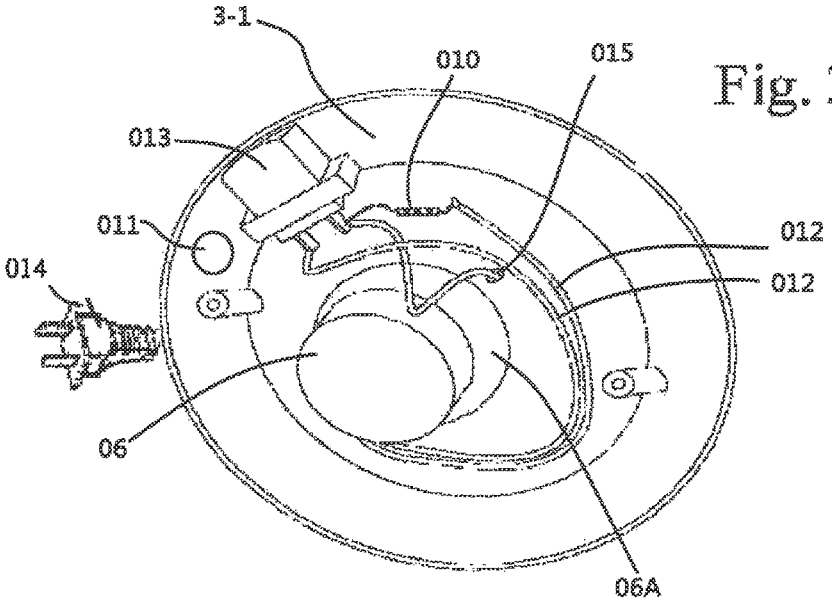

FIG. 1 shows an LED projection light (1) having more than one reflect or-and refraction piece (01), the LED projection light (1) being a plug-in type device having prong (02)-to connect with a wall outlet, extension cord, power station, or desk lamp outlet receptacle. The LED projection light (1) can project the light image to a ceiling, walls, or floor using the more than one optics-lens (01) construction. The optics-piece (02) has more than one convex lens which has the inner surface has plurality of mirror-like polished reflector(s) and an exterior surface of which has a round convex shape to form a respective convex-lens. The plurality of reflective or-and refractive lens may be including in a hemispherical structure (01-T) that is combined with another hemispherical structure (01-L) to form ball shape. Light beams emitted by an LED hit the first reflect-section or area or parts, which reflects the light beams to the second, third, and/or fourth optics section or area or parts until the light beams pass through the convex-lens surfaces to the exterior of the ball shape cover or housing.

As shown in FIG. 2-5, a splendid color image or light-beams (03) (03') (03") in all surrounding areas as shown the light traveling path form one of light-beam (A) emit and reflected to get (A1)(A2), and (A2) reflect again to get (A3) (A4), and refracted to have light-beam (B1) (B3) (B4).

The LEDs (05) (05A) (05B) may have any desired color, specifications, size, functions and each LED (05) (05A) (05B) can have its own emitting direction, orientation, or angle in any direction to emit to the said inner surface or area or sections of the optics-piece(s) has more than one reflecting or-and refracting surfaces or areas or sections so that even though the light emitting angle may be narrow, after the light beam has been reflected or-and refracted, the light will come out all over the ball shape as a result of using (1) more than one LEDs (05) (05A) (05B), and/or (2) more than one reflecting or-and refracting optics-surfaces or areas or sections, and/or (3) more than one optics-lens (01) (01-T) (01-L) (01-inner), and/or (4) interchangeable power sources (03) (03A), including the parts and accessories (010) (011)(012)(013)(04)(055) those described in the inventor's U.S. patent application Ser. Nos. 12/318,471; 12/318,470; 12/834,435; 12/292,153 (now U.S. Pat. No. 7,871,192); Ser. No. 12/232,505 (now U.S. Pat. No. 7,832,917); Ser. No. 12/318,473 (now U.S. Pat. No. 7,832,918); Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. No. 12/886,832; 12/938,564; 12/948,953; and Ser. No. 13/021,107.

FIG. 1-2, FIG. 2-4 shows an alternating current (AC) power unit which has an AC adaptor has circuit-outside housing as FIG. 1-2 (013B) FIG. 2-4 (013A), transformer has circuit outside of housing as FIG. 1-2 (013B) & FIG. 2-4 (013A), and AC wires has circuit inside LED project light housing FIG. 1-2 (013C) to enable the LED projection light to have a splendid projection light image for different locations and applications.

FIGS. 2-2 and 2-5 show a direct current (DC) power unit which can have power from any direct current device such as batteries (04), energy storage including USB power-bank (FIG. 2-5), or solar power system, or wind power system, or chemical power system.

It will be appreciated that interchangeable AC and DC power sources may also be utilized as described in the inventor's U.S. Pat. No. 8,434,927.

FIGS. 1-2 and 2-4 show a plug-in type for LED device with a base (2) that installed AC plug-wire (03A) on the device housing to provide AC power to drive the LEDs by an inner (013C) or outside circuit (013A) (013B) that includes any of a (i) sensor (010), or (ii) switch (011), or (iii) control, (iv) optional motor (06) and gear-set (06A) to make the desired number of optics-lens to rotate; to project an image onto a ceiling, wall, or floor has plenty of color and motion (in case a motor (06) is provided).

The geometrically shaped optics-lens (01) has more than one reflection or-and refraction surfaces or areas or sections (cross lines) which, as shown in FIG. 2 and FIG. 4-1 and FIG. 4-2 may be in the form of a spherical optics-lens (01) having a plurality of flat mirror-polished interior or-and exterior having a round convex exterior surface that forms a convex-lens. Not only can reflect the light beams, but it also can allow light beam refract and transmission.

FIGS. 2-2 and 2-3 and FIG. 2-4, and FIG. 3 and FIG. 3-1 show an AC power LED project light (01) having (I) a receptacle (015) to receive the transformer, adaptor plug (014); or (II) AC wires (03A) to connect with power to cause the LEDs to turn on and project light to desired areas. Power can also be supplied by a USB wire (055) to get power from USB port of other products, as shown in FIG. 2-5.

FIG. 3: The projection LED light (3) has more than one reflective or-and refractive optic-lens to allow light to pass through the convex-lens, and reflect or-and refract within the LED project light housing, thereby projecting an image to a ceiling, wall, or floor.

FIG. 3-1 shows the inner construction of a preferred the projection LED light (3) having built-in motor (06) fixed in the housing (3A) by screw (s) (09). A gear-set (06A) may be provided to reduce the motor's (06) and axis (07) to make desired number of optics-lens (01-T) (01-L) (01-inner) for rotating speed to a slower speed to prevent the image on the ceiling, wall, or floor from moving to rapidly, which would make people uncomfortable. Additional parts and accessories (010)(011)(012)(013)(014)(015) that may be provided include a switch (010) and conductive wires (012) including AC plug-wire to connect with circuit (013) and the power source.

FIG. 4: shows a projection light device which light beams reflect within more than one reflection-surface or areas or parts on an inner side of optics-lens in the shape of a sphere as FIG. 4). The light beams also refracted and pass through optic-lens which has an outside round surface to form convex-lens to project the image to the ceiling, wall, or floor. This embodiment (3-1) thus includes more than one reflection or-and refraction surface or section or areas in the optics-lens, and light projection though the more than one optics-lens (01-T) (01-L) (01-inner) (01-M), the inner side of which is a flat mirror-polished reflector and the outer side of which has a sphere-shape to form convex-lenses, the plurality of the said convex lenses together forming a semi-spherically shaped or more than half of a spherical structure.

From (FIG. 4) The preferred LED projection light application is for outdoor light has the top optic-lens (01-T) cover is a diamond-cut treated optic-lens has LED light source (R2) emit light-beam (R3) to inner flat reflective-area to split into (R3') and reflected light beam (R3') to hit the inner other points or area or segments or parts, and the said reflected light-beam pass through the wall material and deviate basing on the refractive physical theory as light beam (R3") to become refracted light-beam (R3'") came out from the outside surface. The light beam from LED (R3)→reflected→(R3')→refracted→(R3")→refracted→(R3'") this is one of the LED light traveling-path for preferred embodiment which has lower optic-lens (01-L) and top optics-lens (01-L). The LED light-beam (R3) reflected into not only have (R3') but also have the $2^{nd}$ reflected light-beam (R4) →Reflected→(R5)→refracted→(R5')→refracted→R5".
Also, at the same time has the light-beam (R4) also not only reflected into (R5) but also have light-beam (R4')→refracted→(R4')→refracted→(R4")→refracted→(R4'"). The LED single light-beam can has plurality of light-beam been reflected or-and refracted within the lower or-and top optics-lens at same time and incorporate with motor (06) or-and gear-set (06') to make the preferred top or lower optics-lens to rotating will make more splendid lighted pattern or image for moving effects.

So the diamond-cut optic-lens (01-T) for outdoor light front cover to incorporated with inner $1^{st}$ optics-lens (01-L) (01-inner) is a prism-lens which has multiple triangle or teeth like reflectors with thicker thickness can also create splendid light performance. Furthermore, while change the LED color from 1 color to 2 color or more colors and IC control so can make the more assortments light performance outdoor lighting.

FIG. 4-1 shows two spheres optics-len(s) to form the optics-lens(s) assembly. Each one of the optic-lens has more than one reflection to form the more than half-sphere geometric shape ball. This arrangement may use concepts described in the inventor's earlier U.S. Pat. No. 7,632,004, which describes an LED night light base with more than one optics lens, U.S. Pat. No. 8,277,087, which describes an arrangement having more than one reflect lens; U.S. Pat. No. 7,455,444, which describes an LED night light having more than one LED; and U.S. Pat. No. 8,434,927, which describes interchange power sources.

From FIG. 4-1 show how to make the diamond-cut construction or other treatment for optics-lens (01-T) or optic-cover more than ½ ball. The top optic-lens (01-T) cover has one ½ half ball (R9) for top and add or assembled with lower partial of ball preferred optics-treatment optics-lens (01-L) so can make the top cover or top optics-lens (01) has more than ½ ball size. The reason to make more than ½ ball because we need to make much bigger size and more eye-exciting lighted image or-and pattern. The distance from the top cover or top optics-lens (01-T) to the lower (01-L) or inner $1^{st}$ optic-lens has related the best distance which is more than ½ ball because more distance can created more spread-out and more clear image or-and lighted patterns.

From FIG. 4-2) show the top (01-T) or lower (01-L) or inner (01-M) construction of the optic-lens which is diamond-cut optic-lens. The inner surface have a lot of flat surface (R12) which has high polished treated so can easily reflect all input light-beam and reflect to other direction depend on the input-angle of light-beam from LED(s). The one of diamond-cut optic-lens is the preferred for top (01-T) or-and lower (01-L) sphere $2^{nd}$ optic-lens outside is ball type so the outside is round and inner is flat surface so it become the convex lens (R13) so the $2^{nd}$ optic-lens for diamond-cut which also has plurality of the tiny convex-lens which offer the refractive optic-properties. This embodiment clear explain the diamond-cut $2^{nd}$ Top (01-T) optics-lens has both refractive or-and reflective optics properties in one top cover or top-lens to make the lower (01-L) or inner $1^{st}$ optic-lens came out light-beam to make more refraction and-or reflection to get splendid light effects.

In the preferred embodiments, images are created based on the relationship between the first and the second reflective or-and refractive lens or all other optics-lens. The light device can employ any kind of design, shape, display, or geometric shape, arrangement of the said LED project Light. Although specific preferred embodiments of the current invention are described above, it is to be appreciated that all alternative, equivalent, same-function and/or same-skill-or-theory variations, modifications, replacements, arrangements, or constructions may still fall within the current scope of the invention and co-inventor co-pending filed scope.

The invention claimed is:

1. An LED projection light including more than one optics lens having reflective and refractive properties to create an image having a wider viewing angle or range comprising: at least one LED; wherein said optics lens reflects and refracts LED beams multiple times, said at least one optic-lens having a preferred shape in a flat ball or half ball or sphere with desired arc or curvature or wider diameter to cause a narrow angle of LED light beam to be transmitted through the optics lens or lenses or to cause desired lighted patterns or an image to spread out to wider locations to be seen by viewer, wherein the wider spread out lighted patterns or image include any of the following: image, geometric art, nature scene, galaxy, milky way, sky, cloud, stars, moon, water waves, aurora light, animal, characters, cartoon, sign, logo, commercial project image, or emitted light beams to an external surface including at least one of a ceiling, wall (s), wall (s) or other surfaces; wherein the at least one LED is selected from any combination of (a), single color, (b), multiple color, (c), multiple piece, (d), standard, and (e), special LED assembly, wherein said at least one LED is connected to a power source by a conductive device including one of a prong or bulb base or USB plug; and by circuitry including a controller for causing said at least one LED to turn on and off for a predetermined period of time to provide predetermined functions, colors, and effects, wherein the optics lens or lenses is applied to a preferred combination including any of the following; (aa), a product having one optics-lens with a reflective and refractive function or (bb), a product having a plurality of different optics lenses that reflect or refract light beams emitted from the at least one LED and that pass through more than one said reflective and refractive optics lens to present a desired wider viewing angle or big range lighted patterns or image on external locations including at least one of wall, ceiling, floor, fence, house, building, and wherein the LED light gets power from a prong of a plug-in AC outlet, or from a bulb-base screwed into a bulb holder, or from a USB electric wire, or from AC plug wires supplied with power for outdoor use.

2. An LED projection light as recited in claim 1, wherein said more than one reflective and refractive lenses or optics element having different optics properties selected from the group consisting of a mirror, chrome-finished piece, fine-polished piece, double-sided mirror, light transmitting optics lens, and opaque material with at least one opening, cutout, hole, shaped window, light source and stencil.

3. An LED projection light as recited in claim 1, wherein said light patterns or image are provided by a transparent or colored transparent optics-lens with a predetermined texture, thickness, variable plurality of thicknesses, material, shape, convex lens shape, concave lens shape, or at least one lens with a plurality of or variable focus.

4. An LED projection light as recited in claim 1, wherein said power source is selected from the group consisting of an outlet, batteries, solar power, chemical power, and wind power to provide electricity to drive said at least one LED to emit light beams.

5. An LED projection light as recited in claim 1, wherein an additional motor device or assembly and a gear set or moving device fit within the LED light to cause the optic-lens or LEDs to rotate and provide moving image functions, effects, or performance.

6. An LED projection light as recited in claim 1, wherein said at least one LED is selected from a single or multiple color LED, a multiple piece white, red, blue, green, or single color LED, a standard LED, and a custom LED assembly.

7. An LED projection light as recited in claim 1, wherein said LED light is arranged to be plugged into a wall outlet, a power receptacle, and extension cord outlet(s), powered by an AC plug wire that receives power from AC outlets, or powered by cigarette lighter socket receiving-ends or outlet(s).

8. An LED projection light as recited in claim 1, wherein said optics lens is selected from one or more of a light-transmitting lens, reflective lens, convex lens, concave lens, laser lens, or lens having different optics-properties or optics-design on a surface(s) in preferred combinations.

9. An LED projection light having moving lighted patterns including: a plurality of LEDs; at least one optics lens having more than one section or area having a reflective and refractive function to form a one piece optics lens; and wherein said light beam is reflected and refracted multiple times by said section or area to create a plurality light beams, which are enlarged through a reflective and refractive optics lens and spread out to create a wider viewing angle or big range of patterns to be seen, wherein the patterns include an image, lighted patterns, geometric art, a stimulated universe or nature scene including a galaxy, milky way, sky, cloud, stars, moon, water waves, or aurora light, patterns created by film, slide or image display to form an animal, characters, cartoon, sing, logo, or commercial, which are projected to an external location including a ceiling, wall (s), fence, building, house, or other locations or surfaces, wherein the LED light is (a), powered by prongs plugged into an AC outlet or extension cord outlet, (b), powered by an AC plug and wire connected to a source of AC power for outdoor or garden use, (c) powered by a conductive bulb base, (d), powered by a USB connector, or (e), powered by wires, a wireless connection, an adaptor, or a transformer, wherein the LEDs are selected from any combination of single color, multiple color, multiple piece single color, standard, and special LED assemblies, wherein the LEDs include circuitry including a controller for causing respective LEDs to turn on and off for a predetermined period of time to provide predetermined functions, colors, and effects, and wherein the LED light has a motor to move the optics-lens and at least one LED to create moving effects, or the moving effects are created by an integrated circuit to cause the plurality of LEDs to change an on-off timing, duration, or cycles to obtain sequentially flashing, fade-in and fade-out, color changing, random flashing, or turn-on and turn-off, or other LED moving light effects.

10. An LED light for projecting a moving lighted pattern or image, comprising: at least one LED; at least one optical element or optics lens having more than one reflective and refractive sections, areas, or part forming a one-piece optics element; and wherein said sections, areas, or parts and treatments reflect and refract light from said at least one LED multiple times to change a narrow emitting angle LED light beam into pre-determined patterns or shapes or art having a wider angle, direction, or space, wherein the optics-lens has light beam transmitting and enlarging properties to allow light beams to pass through and create a wider viewing angle and big range image, geometric art, a stimulated universe or nature scene including a galaxy, milky way, sky, cloud, stars, moon, water waves, or aurora light, patterns created by film, slide or image display to form an animal, characters, cartoon, sign, logo, or commercial, which are projected to an external location including a ceiling, wall (s), fence, building, house, or other locations or surfaces, wherein the LED light is (a) powered by prongs plugged into an AC outlet or extension cord outlet, (b) powered by an AC plug and wire connected to a source of AC power for outdoor or garden use, (c) powered by a conductive bulb base, (d) powered by a USB connector, or powered by wires, a wireless connection, an adaptor, or a transformer, wherein the at least one LED is selected from any combination of a single color, multiple color, multiple piece, standard, and special LED assembly, wherein said at least one LED is connected to a circuitry including a controller for causing said at least one LED to turn on and off for a predetermined period of time to provide predetermined functions, colors, and effects, wherein motion effects for an image, geometric art, nature scene, galaxy, milky way, sky, cloud, stars, moon, water waves, aurora light, animal, characters, cartoon, sign, logo are made by moving the at least one optics-lens, wherein the at least one optics-lens having a different texture, focus, thickness, wave, curvature, thickness or by moving the at least one optical element other than the optics-lens, the at least one optical element having an opening, painting, art, silkscreen, windows, cutouts, film, slide, LED, or stencil to form the patterns, or by operating at least one of a motor device, spin assembly, rotating assembly, gear assembly, or magnet and coil for a magnetic reaction force with image related parts and accessories; and wherein the LED light is one of a plug-in outlet device, or product having a conductive bulb base, or product having a USB port device, or AC powered outdoor garden light.

* * * * *